United States Patent [19]

Shah

[11] 4,289,800

[45] Sep. 15, 1981

[54] METHOD FOR PROVIDING AN ELECTRICALLY CONDUCTIVE BRIDGE IN CATHODE RAY TUBES

[75] Inventor: Ricky H. Shah, Glendale Heights, Ill.

[73] Assignee: Zenith Radio Corporation, Glenview, Ill.

[21] Appl. No.: 170,206

[22] Filed: Jul. 18, 1980

Related U.S. Application Data

[62] Division of Ser. No. 86,907, Oct. 22, 1979.

[51] Int. Cl.[3] ..... H01J 29/06

[52] U.S. Cl. ..... 427/68; 427/64; 427/122; 313/402

[58] Field of Search ..... 427/68, 64, 122; 313/402, 404, 405, 406, 479

[56] References Cited

U.S. PATENT DOCUMENTS 2,886,476 5/1959 Dumesnil et al. ..... 252/502

3,358,170 12/1967 Fiore ..... 313/406

*Primary Examiner*—Ralph S. Kendall

*Attorney, Agent, or Firm*—Ralph E. Clarke, Jr.

[57] ABSTRACT

A method is disclosed for providing an electrically conductive bridge between the high-voltage charged shadow mask of a color picture tube and the aluminum film deposited on the faceplate to ensure that the aluminum film is charged with the same high voltage present on the shadow mask. A paintable solution is provided which essentially comprises a mixture of substantially equal parts of glass frit particles and graphite particles in the micron-sized range. The particles are in solution in an evaporable solvent including a thickening agent in an amount sufficient to provide a paintable viscosity.

8 Claims, No Drawings

METHOD FOR PROVIDING AN ELECTRICALLY CONDUCTIVE BRIDGE IN CATHODE RAY TUBES

CROSS-REFERENCE TO RELATED APPLICATION

This application is a division of application Ser. No. 86,907 filed Oct. 22, 1979 pending, of common ownership herewith.

BACKGROUND OF THE INVENTION AND PRIOR ART DISCLOSURES

This invention relates in general to color television picture tubes, and in particular to an improved method for establishing certain components within the picture tube envelope at a common electrical potential.

The color television cathode ray picture tube conventionally comprises a glass bulb including a funnel and a faceplate sealed to the flared end of the funnel. An electron gun is mounted in the funnel neck to provide one or more electron beams. The faceplate of the tube has a concave inner surface upon which is deposited groups of phosphors excited by the electron beam or beams. A shadow mask for color selection is attached in precise relationship to the faceplate by means of a plurality of suspension members which detachably engage metal studs extending from the faceplate. An electrically conductive coating, usually a composition comprising colloidal graphite, is applied to the internal surface of the funnel, and a high voltage is in turn applied to this coating from an external power source through an "anode button" in the funnel wall. The high voltage is usually termed the ultor anode potential.

It is common practice to "aluminize" the electron-excitable phosphor screen, a process which comprises the application of an electron-pervious film of aluminum over the phosphor deposits. The film increases the brightness of the display by acting as a mirror to reflect toward the viewer the light produced by the phosphors when excited. The thickness of the aluminum film is typically about 2000 angstroms. For maximum brightness of the display and for brightness uniformity, it is necessary that the aluminum be as smooth and mirror-like as possible, and devoid of blemishes such as holes or blisters. Other necessary qualities include firm adherence of the film to the phosphor layer, and uniform thickness of the film for uniform electron penetration. A problem arises in achieving these qualities primarily because of the unsmooth characteristic of the phosphor deposits. The problem is largely resolved by depositing a film of an organic material such as a lacquer on the phosphor deposits before application of the aluminum. The film acts to fill in uneven areas of the phosphor deposits, and provides a surface upon which the aluminum film can be deposited and take on the relatively smooth characteristic of the lacquer.

It is essential for proper cathode ray tube operation that the high voltage on the conductive coating of the funnel be also present on both the aluminum film and the shadow mask. The electrical path for establishing these components at a common ultor anode potential commonly comprises a spring extending from the shadow mask which is in contact with the high-voltage-charged funnel coating. The potential on the shadow mask is then conducted to the aluminum film through the shadow mask suspension springs which are attached to the metal studs which extend from the faceplate. The studs, which are embedded in the faceplate, are intended to be an electrical contact with the aluminum film; however, this contact often fails to be made. To ensure that the studs are in positive electrical contact with the aluminum film, it has been common practice to paint an electrically conductive "mustache" between the studs and the aluminum coating. The conductive material in common use has comprised a water-soluble silicate in a form suitable for application by a brush. The water is driven off in a subsequent tube baking process, leaving a hard, electrically conductive film between the studs and the aluminum film.

The use of such water-based solutions, which commonly contain either potassium silicate or sodium silicate as a binder, has resulted in a recurrent problem in that the water soluble solution did not "wet" properly, nor did it adhere to components. As a result, fragments of the coating often flaked off the studs and glass areas and become migrant particles. Such migrant particles can occlude one or more apertures in the nearby shadow mask; it is to be noted that the occlusion of even one such aperture is visible to the viewer. Also, the particles can migrate to the gun area and be the cause of inter-electrode arcing or cathode poisoning.

It is known in the art to use a conductive material comprising a mixture of silver with an organic solvent. Any benefits of the material are offset by problems such as its costliness and difficulty of application. Also, silver-bearing compounds usable in this application tend to become more electrically resistive with time, with the resistance increasing to a point where the performance of the coating as an effective conductor is marginal.

To make the water-soluble coating adherent, it has been necessary to introduce an extra baking cycle into the production process. After aluminizing and before applying the conductive mustache, the tube is baked at a temperature of about 400 degrees centigrade. Baking at this temperature eliminates the organic film by oxidizing it. However, as the film can as well be removed by the subsequent frit cycle bake, the requirement for a separate bake merely to promote adherence of the conductive mustache is a costly and energy-wasting step.

OBJECTS OF THE INVENTION

It is a general object of this invention to increase the performance reliability of color cathode ray picture tubes.

It is a less general object of this invention to reduce the cost of production of cathode ray tubes and the amount of energy required in the production process.

It is a more specific object of the invention to reduce production costs and energy consumption by making it possible to eliminate an entire tube bake cycle.

It is a specific object of the invention to provide for the application of an electrically conductive coating that is adherent to the organic films used in the faceplate aluminizing process.

DESCRIPTION OF THE PREFERRED EMBODIMENT

The solution for providing an electrical bridge is intended for use in the manufacture of color cathode ray tubes. Tubes of this type have a phosphor-bearing imaging faceplate overlaid successively with a lacquer film and an aluminum film. A shadow mask charged with a high voltage is held dependent adjacent to the faceplate by a plurality of metallic suspension members extending from the faceplate. It is necessary to provide an electrical bridge between the mask and the aluminum film by way of the suspension members to ensure that the aluminum film is charged with the high voltage of the shadow mask.

An improved bake-hardenable solution according to the invention disclosed in referent copending application Ser. No. 86,907 for providing such an electrical bridge comprises essentially a mixture of substantially equal parts of glass frit particles and graphite particles in the micron-sized range. The particles are in suspension in an evaporable solvent for the lacquer film. The suspension includes a thickening agent in an amount sufficient to produce a paintable viscosity for application by brush means. Upon application of this solution between the suspension members and the aluminum film, the solution hardens to provide a permanent electrically conductive bridge between the mask and the aluminum film.

The solution may have a viscosity in the range of 350–700 centipoises; and preferably about 550 centipoises. After baking, the solution may have an electrical resistance in the range of 1800–2200 ohms per square; preferably about 2000 ohms per square.

A solution for an electrically conductive bridge may be compounded as described in the following paragraphs. The recipe will produce one-half gallon; the amounts can be scaled up as necessary to provide quantities for production. While specific suppliers and their designations are cited, equivalent materials supplied by other suppliers may as well be used.

Pour 450 grams of frit glass particles into a ball mill jar. The glass particles may be those designated as No. 8463, for example, supplied by Corning Glass Works, Corning, New York. Particle size is in the "micron-sized" range; i.e., 1.5±1.0 microns. ("micron-sized" is considered for the purpose of this disclosure to be ten microns or less in size.)

Add 288 grams of butyl cellosolve. This may be the type designated as E179, supplied by Fisher Scientific Co., Elk Grove, Illinois.

Add 270 grams of 4% nitrocellulose. This compound is prepared as a stock solution using nitrocellulose R.S. 650–1000 in amyl acetate. The 4% nitrocellulose solution is made by dissolving 5.7 grams of nitrocellulose in 94.3 grams of amyl acetate. The percentage of nitrocellulose may be in the range of 3 to 5 percent. It is noted that it may take more than 24 hours of moderate agitation to solubilize the nitrocellulose.

The nitrocellulose may be of the type designated as R.S. 600 1SO-WET 30, supplied by Scholle Chemical Co., Northlake, Illinois. The amyl acetate is the reagent grade supplied by Mallinckrodt, Inc., St. Louis, Mo.

The frit glass, butyl cellosolve and 4% nitrocellulose solution is ball-milled in a jar mill at 60–90 revolutions per minute. The grinding medium may comprise burundum in the form of one-half inch cylinders. Ball milling requires about 2 hours.

The following are added to the ball-milled suspension:

450 grams of graphite powder HPN2, HP2 or 200–39 as supplied by Joseph Dixon Crucible Co., Jersey City, N.J. Particle size is about 5 microns.

900 grams of butyl cellosolve.

144 grams of Ektasolve deacetate as supplied by Eastman Chemical Products, Inc., Kingsport, Tennessee.

120 grams of Acheson Electrodag 154 as supplied by Acheson Colloids Co., Port Huron, Michigan.

Ball milling of the foregoing mixture is continued for about 16 hours. The suspension is then poured into a suitable container such as a one-half gallon polyethylene jar. The suspension comprises 36% solids±1.5 having a viscosity of 550±150 centipoises as measured with a Brookfield LTV viscosimeter using spindle No. 3 to 60 rpm.

Approximate percentages by weight of the ingredients compounded according to the foregoing, and the preferred range in weight-percentages, comprise the following:

| INGREDIENT | Quantity, % | WEIGHT-PERCENT PREFERRED RANGE |
|---|---|---|
| frit powder glass 8463 | 17.16 | 14–21 |
| graphite | 17.16 | 14–21 |
| butyl cellosolve | 45.32 | 42–48 |
| Ektasolve deacetate | 5.48 | 4.5–7 |
| 4% nitrocellulose | 10.30 | 8–12 |
| Electrodag | 4.58 | 3–6 |
| | 100.00 | |

The frit glass powder component comprises the binding medium for the solution. The graphite comprises the electrically conductive medium. The butyl cellosolve is the solvent which enables the compound to penetrate the organic film, or lacquer. The Ektsolve deacetate acts as a leveling agent, while the nitrocellulose acts as a thickening agent to provide the required viscosity. The Acheson Electrodag, which consists of a very fine graphite compound, acts as a "smoothening" agent to facilitate application of the solution by means of a brush. The solution becomes hard at a temperature in the range of 350° C. to 430° C.

The solvent component of the solution—butyl cellosolve—penetrates the organic film, or lacquer, which has coated the metallic suspension members in consequence of the aluminizing process. By this penetration, the solution is able to establish a positive electrical connection with the suspension members to which the shadow mask is attached and with which it is in electrical contact. The solution also establishes positive electrical contact over an extensive area of the aluminum film which, as has been noted, is only about 200 angstroms thick. Thus, a positive and permanently adherent electrical bridge is established between the shadow mask and the aluminum film.

The solution has, as has been noted, a slight electrical resistivity after bake-hardening which is in the range of 1800 to 2200 ohms per square, preferably 2000 ohms per square. Without this quality, a high potential static charge could build up on the compound which could have a deleterious effect on picture tube operation.

The method according to the invention for providing an electrically conductive bridge between a shadow mask and aluminum film is for use in the manufacture of a color cathode ray picture tube. The high-voltage-charged shadow mask is held dependent adjacent to the phosphor-layered faceplate of the tube by a plurality of metallic suspension members extending from the faceplate.

The method is of the type including the steps of:

(a) baking the tube to drive off the lacquer by oxidation;

(b) providing a bake-hardened water-soluble solution that is electrically conductive when hardened;

(c) painting on the solution to form a bridge between the suspension members and the mask, and the aluminum film.

The improvement according to the invention comprises in lieu of step (b), providing a bake-hardenable solution which comprises a mixture of substantially equal parts of glass frit particles and graphite particles in the micron-sized range. The particles are in suspension in an evaporable solvent for the lacquer. The suspension includes a thickening agent in an amount sufficient to produce a paintable viscosity in the solution for application by brush means. Upon application of the solution according to the invention between the shadow mask suspension members and the aluminum film, the solution penetrates the lacquer film. When the tube is baked, as in the standard frit-bake cycle, the solution becomes a permanent electrically conductive bridge between the mask and the aluminum film, whereby it is possible to eliminate step (a)—baking the tube specifically to oxidize the lacquer. Eliminating the need for a separate bake provides for a significant reduction in production cost and energy consumption.

The solution has been described as intended for application to provide an electrical bridge between the shadow mask and the aluminum film by way of the mask suspension members. The invention is by no means limited to such a specific application; for example, the solution can as well be used for painting an electrical bridge on the inner wall of the cathode ray tube according to the inventive method to electrically interconnect other discrete, components located contiguous to the inner wall of the tube.

The solution exhibits many beneficial properties. For example, as it has the same coefficient of expansion as the glass of the picture tube, it will not flake off or otherwise release migrant particles which could interfere with tubeoperation. The solution is immune to the rigors of the production process such as the frit bake cycle wherein temperatures may reach 430° C. In its fluid state; that is, after it is painted on to establish the bridge and before it is hardened by baking, it will not spread or otherwise flow beyond the limits of area to which it is applied. Further, it is highly adherent both to the aluminum film and to the metal of the suspension members, both when in the form of a solution, and after baking. Its consistency is such that it can be easily and quickly brushed onto the parts to be bridged. Once compounded, it has a relatively long shelf life of up to two years.

It must be recognized that changes may be made in the inventive method without departing from the true spirit and scope of the invention herein involved. It is intended that the subject matter in the above depiction shall be interpreted as illustrative and not in a limiting sense.

I claim:

1. For use in the manufacture of a color cathode ray picture tube, a method for providing an electrically conductive bridge between a high-voltage-charged shadow mask held dependent adjacent to the phosphor-layered faceplate of said tube by a plurality of metallic suspension members extending from said faceplate, and an aluminum film overlayed on a lacquer deposited on said phosphor layer, the method being of the type including the steps of:

(a) baking said tube to drive off said lacquer by oxidation;

(b) providing a bake-hardenable water-soluble solution that is electrically conductive when hardened;

(c) painting on said solution to form said bridge between said suspension members and said mask, and said aluminum film;

an improvement which comprises;

in lieu of step (b), providing a bake-hardenable solution which comprises a mixture of substantially equal parts of glass frit particles and graphite particles in the micron-sized range, said particles being in suspension in an evaporable solvent for said lacquer, said suspension including a thickening agent in an amount sufficient to produce a paintable viscosity for application by brush means;

such that upon application of said solution between said suspension members and said aluminum film, said solution penetrates said lacquer film, and when baked, said solution provides a permanent electrically conductive bridge between said mask and said aluminum film, whereby step (a)—baking said tube to remove said lacquer can be eliminated, providing a significant reduction in production costs and energy consumption.

2. The solution according to the invention defined by claim 1 wherein said solution has a viscosity in the range of 350–700 centipoises.

3. The solution according to the invention defined by claim 1 wherein the resistance of said solution after bake-hardening is in the range of 1800–2200 ohms per square.

4. For use in the manufacture of a color cathode ray picture tube, a method for providing an electrically conductive bridge between a high-voltage-charged shadow mask held dependent adjacent to the phosphor-layered faceplate of said tube by a plurality of metallic suspension members extending from said faceplate, and an aluminum film overlayed on a lacquer deposited on a said phosphor layer, the method being of the type including the steps of:

(a) baking said tube to drive off said lacquer by oxidation;

(b) providing a bake-hardenable water-soluble solution that is electrically conductive when hardened;

(c) painting on said solution to form said bridge between said suspension members and said mask, and said aluminum film;

an improvement which comprises;

in lieu of step (b), providing a bake-hardenable solution consisting essentially of:

a binding medium comprising frit glass of particle size in the range of $1.5 \pm 1.0$ microns and consisting of about 14 to 21 weight percent of said solution;

an organic solvent comprising butyl cellosolve consisting of about 42 to 48 weight percent;

a thickening agent comprising a 3 to 5 percent solution of nitrocellulose in amyl acetate, the agent consisting of about 8 to 12 weight percent:

an electrically conductive medium comprising graphite powder of about 5 micron particle size, and consisting of about 14 to 21 weight percent;

a leveling agent and a smoothening agent;

such that upon application of said solution between said suspension members and said aluminum film, said solution penetrates said lacquer film, and when baked, said solution provides a permanent electrically conductive bridge between said mask and said aluminum film, whereby step (a)—baking said tube to remove said lacquer can be eliminated, providing a significant reduction in production costs and energy consumption.

5. The solution according to the invention defined by claim 4 wherein said solution has a viscosity in the range of 350–700 centipoises.

6. The solution according to the invention defined by claim 4 wherein the resistance of said solution after bake-hardening is in the range of 1800–2200 ohms per square.

7. The solution according to the invention defined by claim 4 wherein said leveling agent comprises Eastman Ektasole deacetate of about 4.5 to 7 weight percent.

8. The solution according to the invention defined by claim 4 wherein said smoothening agent comprises Acheson Electrodag 154 of about 3 to 6 weight percent.

* * * * *